US005764784A

United States Patent [19]

Sato et al.

[11] Patent Number: 5,764,784

[45] Date of Patent: Jun. 9, 1998

[54] ELECTROACOUSTIC TRANSDUCER

[75] Inventors: Hiroshi Sato, Daito; Akira Yoshino, Ikoma, both of Japan

[73] Assignee: Sanyo Electric Co., Ltd., Moriguchi, Japan

[21] Appl. No.: 525,424

[22] Filed: Sep. 7, 1995

[30] Foreign Application Priority Data

Sep. 12, 1994 [JP] Japan ..... 6-217196

[51] Int. Cl.[6] ..... H04R 25/00

[52] U.S. Cl. ..... 381/199; 381/194; 381/192; 381/203

[58] Field of Search ..... 381/192, 203, 381/199, 194

[56] References Cited

U.S. PATENT DOCUMENTS 5,155,773 10/1992 Hansen ..... 381/192
5,157,731 10/1992 Mitobe ..... 381/199

FOREIGN PATENT DOCUMENTS 2 153 628 8/1985 United Kingdom .

*Primary Examiner*—Sinh Tran
*Attorney, Agent, or Firm*—Armstrong, Westerman, Hattori, McLeland & Naughton

[57] ABSTRACT

A flat casing is formed by joining a hollow cylindrical cover to a hollow cylindrical frame, and a d.c. magnetic field generating magnet in the form of a disk is fixed to the inner surface of the cover. Disposed inside the casing is a disklike diaphragm spaced apart from the lower surface of the magnet by a gap and having its outer peripheral portion fixedly held between the cover and the frame. A hollow cylindrical drive coil coaxial with the magnet is fixed to the lower surface of the diaphragm and has an axis perpendicular to the diaphragm. Stated specifically, the drive coil has an outside diameter which is at least 80% to not greater than 116% of the outside diameter of the magnet and an inside diameter which is at least 66% to not greater than 94% of the magnet outside diameter. The transducer is diminished in power consumption, has a reduced thickness and is yet highly efficient.

7 Claims, 12 Drawing Sheets

FIG. 9

| | DIAMETER (mm) | OVERALL HEIGHT (mm) | IMPEDANCE (Ω) (1kHz) | SOUND PRESSURE LEVEL (dB) (0.01W/1kHz) | NUMBER OF PARTS (pcs) |
|---|---|---|---|---|---|
| 1ST EMBODIMENT (FIG. 1) | φ 20.0 | 3.4 | 150 | 113 | 6 |
| 2ND EMBODIMENT (FIG. 6) | φ 20.0 | 3.4 | 150 | 109 (※115) | 7 |
| DYNAMIC TYPE (FIG. 12) | φ 20.0 | 3.5 | 32 | 124 | 8 |
| MAGNETIC TYPE (FIG. 13) | φ 21.0 | 3.8 | 150 | 112 | 7 |

※WITHOUT SOUND ABSORBING MATERIAL

ELECTROACOUSTIC TRANSDUCER

FIELD OF THE INVENTION

The present invention relates to electroacoustic transducers for converting electrical signals into sound by passing alternating electric current through a drive coil to produce a drive force and causing the drive force to vibrate a diaphragm, and more particularly to electroacoustic transducers having a construction which is useful for reducing a thickness to the transducer.

BACKGROUND OF THE INVENTION

Already known as electroacoustic transducers are dynamic loudspeakers which utilize an electromagnetic force according to Fleming's left-hand rule, and magnetic loudspeakers which exploit the attraction and repulsion resulting from magnetic induction.

The dynamic speaker will be described first, and the magnetic speaker will be described next.

FIG. 12 shows the construction of a dynamic speaker. A flat casing comprises a hollow cylindrical cover 14 having an open end, and a hollow cylindrical frame 23 having an open end and the same outside diameter as the cover 14 and joined to the cover 14. The cover 14 is formed with a plurality of small holes 15 in a circular arrangement for releasing sound therethrough. A diaphragm 42 in the form of a disk is disposed in the casing centrally thereof. The diaphragm 42 is fixedly held at its outer peripheral portion between the cover 14 and the frame 23. Fixed to the lower surface of the diaphragm 42 is a hollow cylindrical drive coil 52 having its axis positioned perpendicular to the diaphragm. The frame 23 is inwardly recessed at its central portion, and a disklike yoke 9 is attached to the recessed portion. A d.c. magnetic field generating magnet 31 in the form of a disk is fixedly mounted on the yoke 9 centrally thereof. A pole piece 91 is attached to the upper surface of the magnet 31. An annular gap G' is formed between the pole piece 91 and the yoke 9. The drive coil 52 is accommodated in the gap G' as loosely fitted therein. The casing is provided with electrodes 61 for passing alternating current through the coil 52.

With the dynamic speaker, the magnet 31 produces magnetic flux, which is guided by the yoke 9 and the pole piece 91 and concentrated at the gap G' as indicated in broken lines in the drawing, whereby a magnetic field is set up in the gap G'. When an electrical signal (alternating current) is passed through the drive coil 52 via the electrodes 61, the drive coil 52 produces an electromagnetic force according to Fleming's left-hand rule. As a result, the diaphragm 42 vibrates with the coil 52, whereby the electrical signal is converted into sound.

The magnetic speaker will be described next.

FIG. 13 shows the construction of a magnetic speaker. A flat casing comprises a hollow cylindrical cover 16 having an open end, and a hollow cylindrical frame 24 having an open end and the same outside diameter as the cover 16 and joined to the cover 16. The cover 16 has a pole piece 92 in the form of a round rod and projecting downward from its inside central portion, and is formed with a plurality of small holes 17 in a circular arrangement around the pole piece 92 for releasing sound therethrough. Disposed around the pole piece 92 is a drive coil 53 fixed to the inner surface of the cover 16. The coil 53 is surrounded by a d.c. magnetic field generating magnet 32 fixed to the inner surface of the cover 16. On the other hand, a diaphragm 43 is mounted on the frame 24 with a specified gap G" provided between the pole piece 92 and the diaphragm, and has an outer periphery fixed to the inner peripheral wall of the frame 24.

With the magnetic speaker, the magnet 32 produces magnetic flux, which is guided by the pole piece 92 and the cover 16 and concentrated at the gap G" as indicated in broken lines in the drawing and reaches the diaphragm 43 through the gap G", whereby a magnetic field is set up in the gap G", magnetizing the diaphragm 43 by magnetic induction. Consequently, the diaphragm 43 elastically deforms by being subjected to a force of attraction of the pole piece 92 and comes to rest at a dynamic midpoint where the force of attraction is in balance with an elastic restoring force. When an electric signal (alternating current) is then passed through the drive coil 53 via electrodes 62, the coil 53 produces a magnetic field according to the right-hand screw rule. This magnetic field changes the magnetic field set up in the gap G", consequently altering the force of attraction acting on the diaphragm 43, which in turn vibrates as centered at the dynamic midpoint.

However, the dynamic speaker of FIG. 12 is not fully efficient since there is a large amount of leakage flux which does not contribute to the driving of the diaphragm 42 as a loss.

Further from the viewpoint of power consumption, it is advantageous that the impedance be higher. A higher impedance requires a greater number of turns of the drive coil 52. This can be accomplished by increasing the number of turns with respect to the radial direction of the coil 52, or with respect to the axial direction thereof. The former method increases the width of the gap G' and therefore results in an increased amount of leakage flux loss. The latter method has a problem in that the entire thickness of the speaker increases with an increase in the axial length of the drive coil 52.

On the other hand, the elongated magnetic speaker of FIG. 13 has a problem in that the pole piece 92 projecting beyond the drive coil 53 gives an increased thickness to the speaker in its entirety.

Although reducing the gap G" between the pole piece 92 and the diaphragm 43 is effective for diminishing the leakage flux to achieve a higher efficiency, an excessive reduction of the gap G" entails the problem that the diaphragm 43 comes into contact with the pole piece 92 to give off a noise. This can be precluded by using a diaphragm 43 of enhanced rigidity, whereas the diaphragm then encounters difficulty in emitting a low sound, hence a reduced compass. Consequently, the gap G" has a considerably great value which leads to a low efficiency.

Furthermore, the dynamic speaker and the magnetic speaker require use of the yoke and pole piece and are therefore composed of a large number of parts. This imposes limitations on the design of the drive coil to entail the problem of low impedance.

SUMMARY OF THE INVENTION

An object of the present invention is to provide an electroacoustic transducer which is diminished in power consumption, has a reduced thickness and is nevertheless highly efficient.

The present invention provides an electroacoustic transducer which comprises a diaphragm having a peripheral portion as a fixed end, a hollow cylindrical drive coil fixed to one surface of the diaphragm centrally thereof and having an axis perpendicular to the diaphragm, and a d.c. magnetic field generating magnet in the form of a disk and fixed in position as spaced apart from the diaphragm and the drive coil by a predermined gap, the magnet being coaxial with the drive coil. A major portion of the magnetic flux emanating from the entire area of the surface of the magnet facing the diaphragm extends to the drive coil through the gap.

When an alternating current is passed through the drive coil of the transducer of the invention, the drive coil produces magnetic flux according to the right-hand screw rule. On the other hand, the magnet emanates magnetic flux toward the drive coil. Since the drive coil in this case can be considered to be a magnet having alternating magnetic poles, the coil is subjected to a force of attraction or repulsive force in connection with the magnet, with the result that the diaphragm vibrates with the drive coil, whereby an electric signal is converted into sound.

In this way, the magnetic flux emanating from the magnet is allowed to extend through the gap without being concentrated, so that there is no need for a yoke or pole piece. This reduces the number of components and gives a reduced thickness to the transducer. The present device is free of the limitations to be imposed thereon by the yoke or pole piece in design and can therefore be designed as desired so as to be diminished in thickness and further to give an increased impedance by increasing the number of turns of the drive coil.

Specifically stated, the outside diameter of the drive coil is at least 80% to not greater than 116%, preferably at least 88% to not greater than 107%, of the outside diameter of the d.c. magnetic field generating magnet.

Since the drive coil has an outside diameter in the above-specified range, the magnetic flux emitted by the magnet emanates from the magnet surface approximately perpendicular thereto in the central portion of the magnet and penetrates the drive coil approximately perpendicular thereto, while at the peripheral portion of the magnet, the flux radially spreads out from the magnet surface and obliquely penetrates the drive coil. Accordingly, the drive coil is subjected to a force of attraction or repulsive force by the magnetic flux thus penetrating the coil perpendicular thereto. At the same time, the oblique penetrating magnetic flux exerts a similar force of attraction or repulsive force produced by a component thereof which is perpendicular to the diaphragm, and produces an electromagnetic force by a horizontal component thereof according to Fleming's left-hand rule. Consequently, the drive forces based on the two principles described act on the drive coil at the same time to drive the diaphragm efficiently.

Further stated specifically, the inside diameter of the drive coil is at least 66% to not greater than 94%, preferably at least 77% to not greater than 89%, of the outside diameter of the magnet.

Experiments have revealed that the drive force due to the flux obliquely penetrating the drive coil contributes largely to the driving of the diaphragm like the drive force due to the flux penetrating the coil approximately perpendicular thereto. Accordingly, the drive coil is given an inside diameter of the above-specified range so as to drive the diaphragm mainly by the drive force due to the oblique penetrating flux. The reduction in the weight of the drive coil thus effected diminishes the mass of the vibration system including the diaphragm to improve the responsiveness of the system and consequently achieve an improved efficiency.

Stated more specifically, the drive coil is fixed to the diaphragm on the surface thereof facing the magnet or on the other surface thereof opposite to the magnet. In either case, the diaphragm is driven on the foregoing principle.

With the electroacoustic transducer of the present invention, the yoke or pole piece can be dispensed with, whereby the device can be made thinner. The desired design free of the limitations to be imposed by the yoke or pole piece makes it possible to increase the impedance by giving an increased number of turns to the drive coil and to thereby reduce the power consumption. Moreover, the magnetic flux produced by the d.c. magnetic field generating magnet is effectively used for driving the diaphragm to realize electroacoustic transduction with an improved efficiency.

BRIEF DESCRIPTION OF THE DRAWINGS

FIG. 9 is a table showing various characteristics of the first and second embodiments and the conventional speakers;

DETAILED DESCRIPTION OF EMBODIMENTS

With reference to the drawings, a detailed description will be given of two small speakers embodying the invention for use in portable telephones, etc.

First Embodiment

Figure 1:
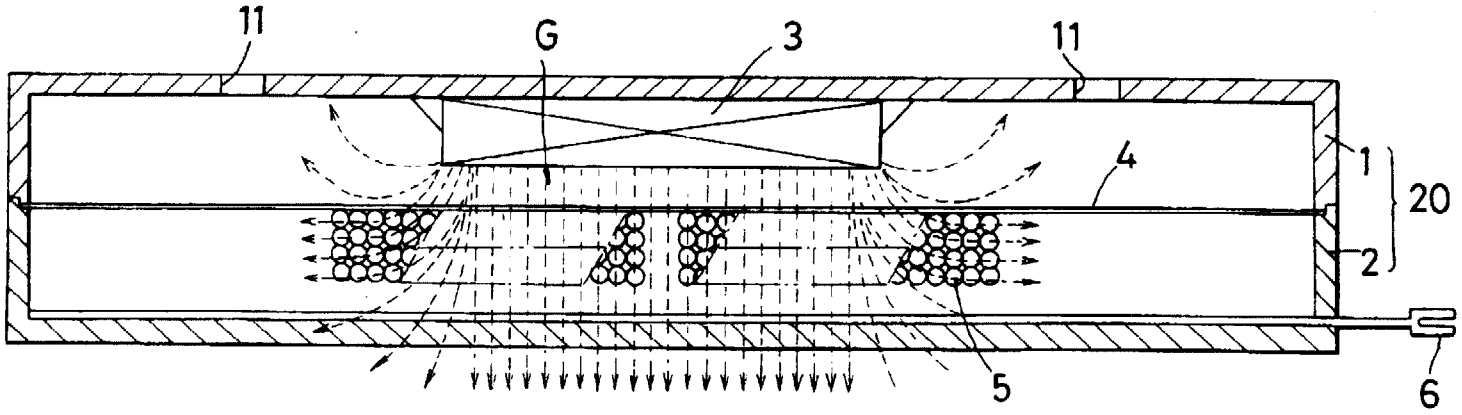
FIG. 1 is a sectional view showing the construction of a speaker as a first embodiment.
Figure 2:
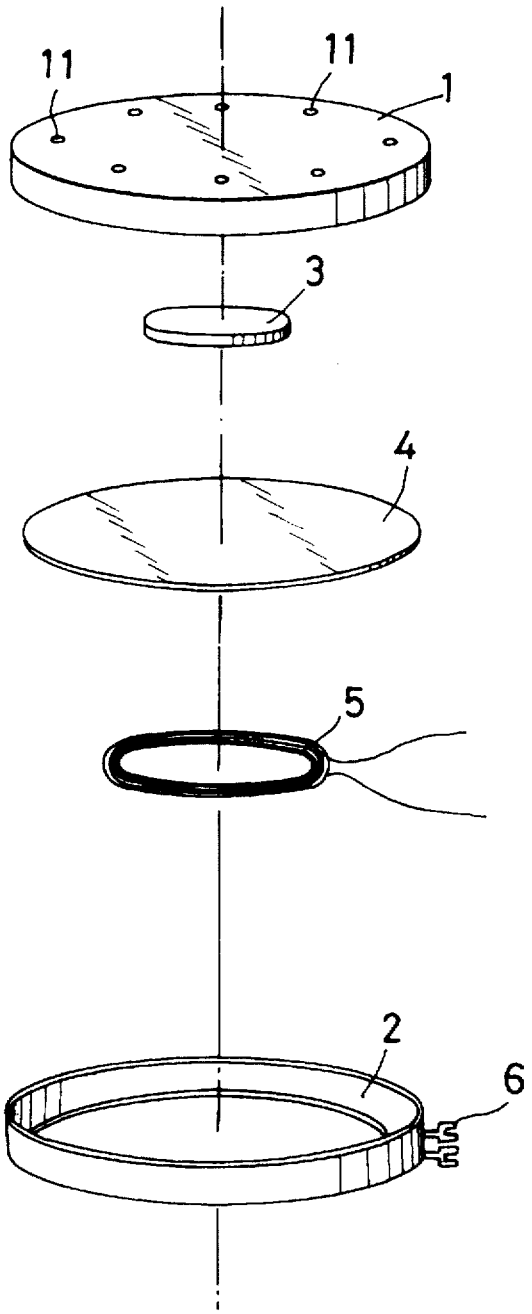
FIG. 2 is an exploded perspective view of the embodiment.

FIG. 1 is a sectional view showing the construction of a speaker as a first embodiment, and FIG. 2 is an exploded perspective view of the speaker.

A hollow cylindrical cover 1 having an open end is joined to a hollow cylindrical frame 2 having an open end and the same outside diameter as the cover 1, whereby a flat casing 20 is formed. The cover 1 and the frame 2 are made of a resin such as polybutylene terephthalate PBT or polyacetal POM.

The cover 1 is formed with a plurality of small holes 11 in a circular arrangement for releasing sound therethrough.

A d.c. magnetic field generating magnet 3 consisting primarily of neodymium, samarium, cobalt or the like and in the form of a disk, 9.0 mm in outside diameter and 1.0 mm in thickness, is fixed to the inner surface of the cover 1 concentrically therewith with an acrylic, epoxy or like thermosetting adhesive.

Disposed inside the casing 20 is a disklike diaphragm 4 spaced apart from the lower surface of the magnet 3 by a gap G of 0.6 mm. The diaphragm 4 has an outer peripheral portion held between the cover 1 and the frame 2 and fixed thereto with an adhesive. The diaphragm 4 is made of a resin sheet, such as a sheet of polyimide PI, polyether imide PEI or polyethylene terephthalate PET, having a thickness of 50 to 75 micrometers.

Fixed to the lower surface of the diaphragm 4 with a rubber adhesive is a drive coil 5 coaxial with the magnet 3 and having an axis perpendicular to the diaphragm 4. The drive coil 5 is in the shape of a hollow cylinder measuring 1.0 mm in inside diameter, 9.5 mm in outside diameter and 0.25 mm in thickness and formed by winding a copper wire, 0.04 mm in diameter.

Electrodes 6 made of brass, phosphor bronze or the like for passing an alternating current through the drive coil 5 are fixed to the bottom of the frame 2 along its inner peripheral wall by thermal bonding. Lead wires (not shown) extending from the coil 5 are connected by soldering to the inner ends of the respective electrodes 6.

As indicated in broken lines in FIG. 1, the magnetic flux emitted by the magnet 3 emanates from the magnet surface approximately perpendicular thereto in the central portion of the magnet 3 and penetrates the drive coil 5 approximately perpendicular thereto, while at the peripheral portion of the magnet, the flux radially spreads out from the magnet surface and obliquely penetrates the drive coil 5.

Figure 3:
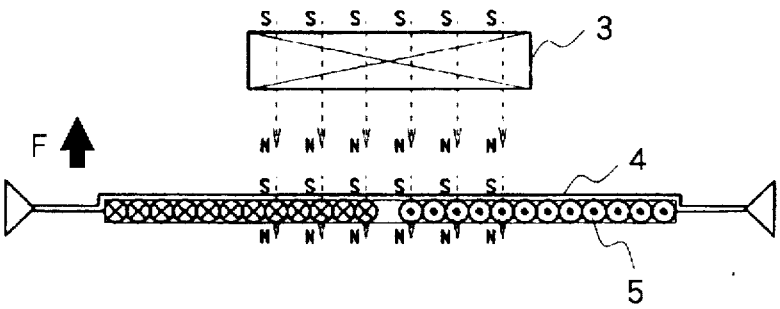
FIGS. 3 (*a*) and 3 (*b*) are diagrams showing the direction of drive forces produced when current is passed through a drive coil clockwise in the above embodiment.
Figure 3:
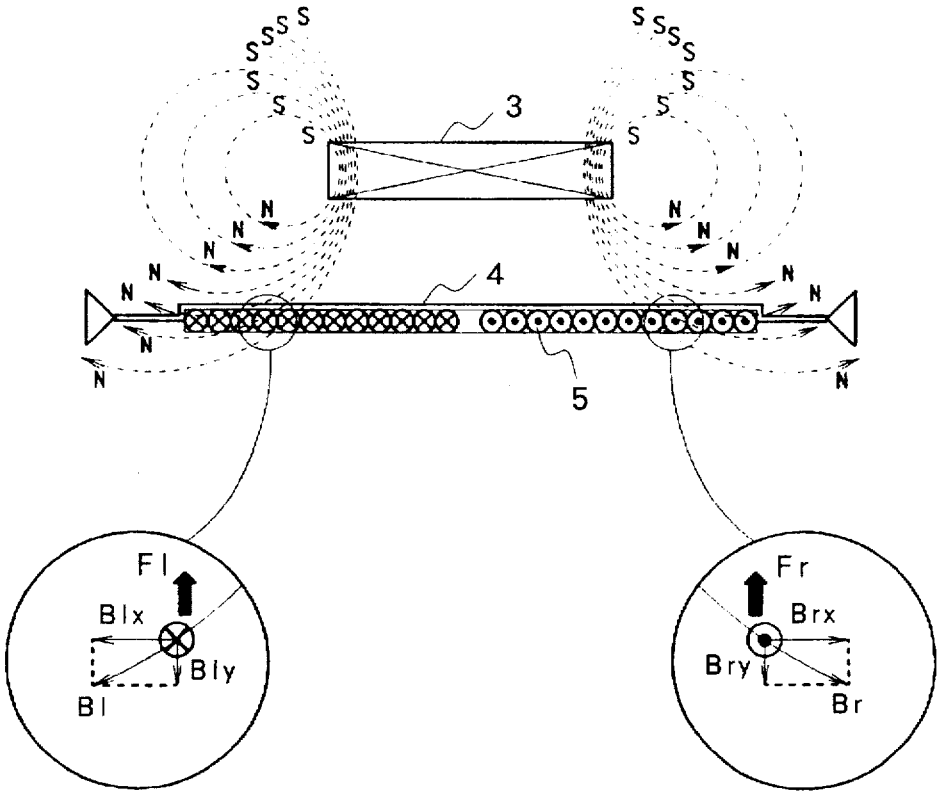

FIGS. 3 (*a*) and 3 (*b*) show the direction of drive forces produced when current is passed through the drive coil 5 clockwise.

FIG. 3 (*a*) shows magnetic flux emanating from the central portion of the magnet 3 approximately perpendicular thereto and penetrating through the drive coil 5 approximately perpendicular thereto, and the direction of a drive force produced by the flux and acting on the coil 5.

When current is passed through the coil 5 clockwise, the coil 5 produces downward magnetic flux according to the right-hand screw rule as indicated in broken lines. On the other hand, the magnet 3 has N poles on the coil side and S poles on the opposite side, and produces downward flux toward the drive coil 5 as indicated in broken lines. As a result, S poles appear at the magnet side of the coil 5 and N poles at the opposite side thereof, and an upward force of attraction F acts between the coil 5 and the magnet 3.

FIG. 3 (*b*) shows magnetic flux radially spreading out from the peripheral portion of the magnet 3 toward the drive coil 3 and obliquely penetrating through the coil 5, and the direction of drive forces produced by the flux and acting on the coil 5.

On the right-hand side of the drawing, magnetic flux Br emanating from the magnet 3 and extending obliquely to the drive coil 5 is separated into a horizontal component Brx parallel to the diaphragm and a component Bry perpendicular to the diaphragm 4 as illustrated. The perpendicular component Bry produces an upward force of attraction acting on the coil 5 and similar to that of FIG. 3 (*a*). On the other hand, the horizontal component Brx produces an electromagnetic force Fr in a direction according to Fleming's left-hand rule in connection with the current through the drive coil 5, i.e., an upward force Fr in the drawing.

On the left-hand side of the drawing, magnetic flux Bl emanating from the magnet 3 and extending obliquely to the drive coil 5 is separated into a horizontal component Blx parallel to the diaphragm 4 and a component Bly perpendicular to the diaphragm 4 as illustrated. The perpendicular component Bly produces an upward force of attraction acting on the drive coil 5 and similar to that of FIG. 3 (*a*). On the other hand, the horizontal component Blx produces an electromagnetic force Fl in a direction according to Fleming's left-hand rule in connection with the current through the drive coil 5, the force Fl acting upward in the drawing.

Consequently, the drive coil 5 is subjected to an upward drive force in its entirety owing to the upward force of attraction shown in FIG. 3 (*a*) and the upward forces of attraction and the electromagnetic forces shown in FIG. 3 (*b*).

Figure 4:
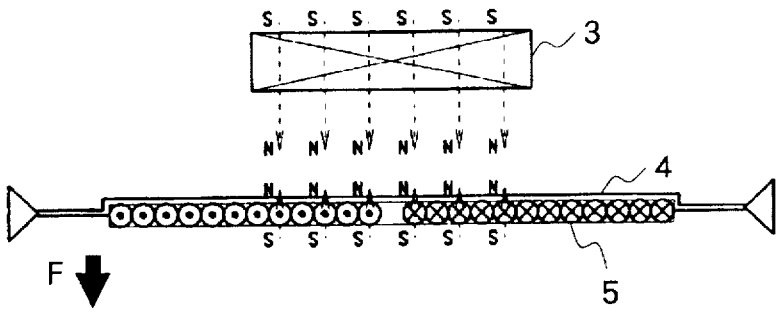
FIGS. 4 (*a*) and 4 (*b*) are diagrams showing the direction of drive forces produced when current is passed through the drive coil counterclockwise in the embodiment.
Figure 4:
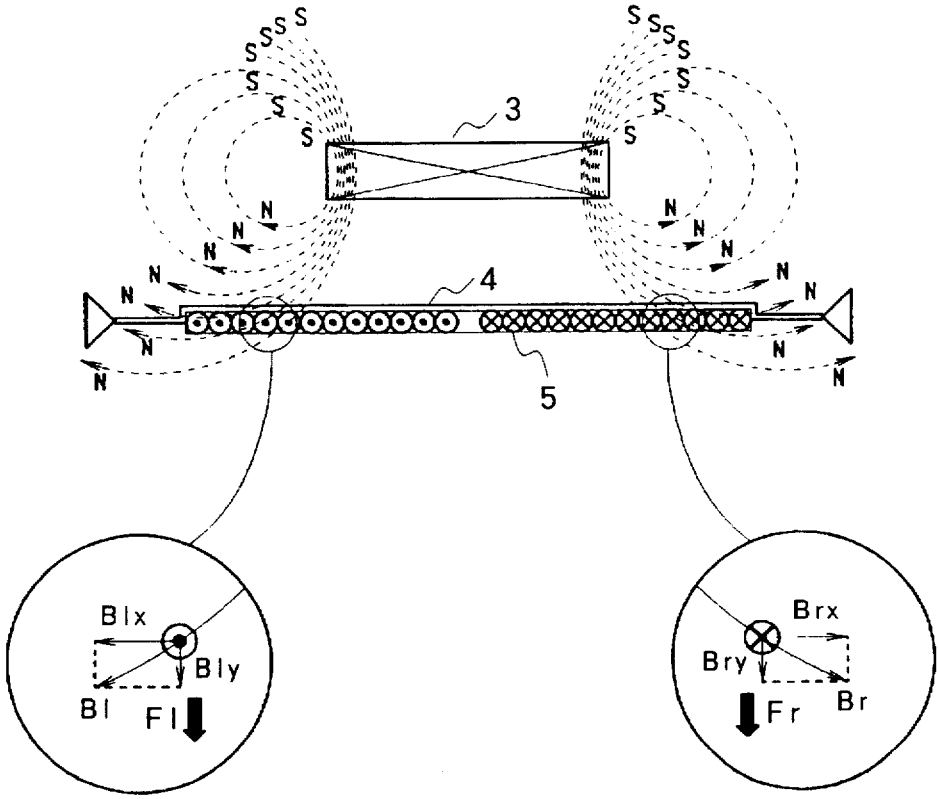

FIGS. 4 (*a*) and 4 (*b*) show the direction of drive forces produced when current is passed through the drive coil 5 counterclockwise.

FIG. 4 (*a*) shows magnetic flux emanating from the central portion of the magnet 3 approximately perpendicular thereto and penetrating through the drive coil 5 approximately perpendicular thereto, and the direction of a drive force produced by the flux and acting on the coil 5.

When current is passed through the coil 5 counterclockwise, the coil 5 produces upward flux according to the right-hand screw rule as indicated in broken lines. As a result, N poles appear on the magnet side of the coil 5 and S poles on the opposite side thereof, and a downward repulsive force F acts between the coil 5 and the magnet 3.

FIG. 4 (*b*) shows magnetic flux radially spreading out from the peripheral portion of the magnet 3 toward the drive coil 3 and obliquely penetrating through the coil 5, and the direction of drive forces produced by the flux and acting on the coil 5.

On the right-hand side of the drawing, magnetic flux Br emanating from the magnet 3 and extending obliquely to the drive coil 5 is separated into a horizontal component Brx parallel to the diaphragm 4 and a component Bry perpendicular to the diaphragm 4 as illustrated. The perpendicular component Bry produces a downward repulsive force acting on the coil 5 and similar to that of FIG. 4 (*a*). On the other hand, the horizontal component Brx produces an electromagnetic force Fr in a direction according to Fleming's left-hand rule in connection with the current through the drive coil 5, the force Fr acting downward in the drawing.

On the left-hand side of the drawing, magnetic flux Bl emanating from the magnet 3 and extending obliquely to the drive coil 5 is separated into a horizontal component Blx parallel to the diaphragm 4 and a component Bly perpendicular to the diaphragm 4 as illustrated. The perpendicular component Bly produces a downward repulsive force acting on the drive coil 5 and similar to that of FIG. 4 (*a*). On the other hand, the horizontal component Blx produces an electromagnetic force Fl in a direction according to Fleming's left-hand rule in connection with the current through the drive coil 5, the force Fl acting downward in the drawing.

Consequently, the drive coil 5 is subjected to a downward drive force in its entirety owing to the downward repulsive force shown in FIG. 4 (*a*) and the downward repulsive forces and electromagnetic forces shown in FIG. 4 (*b*).

The current passed through the drive coil 5 as an electric signal is an alternating current. Since the direction of the current through the coil 5 changes with time, the coil 5 is alternately subjected to the upward drive force shown in FIG. 3 and the downward drive force shown in FIG. 4. As a result, the diaphragm 4 vibrates with the drive coil 5, whereby the electric signal is converted into sound.

Figure 5:
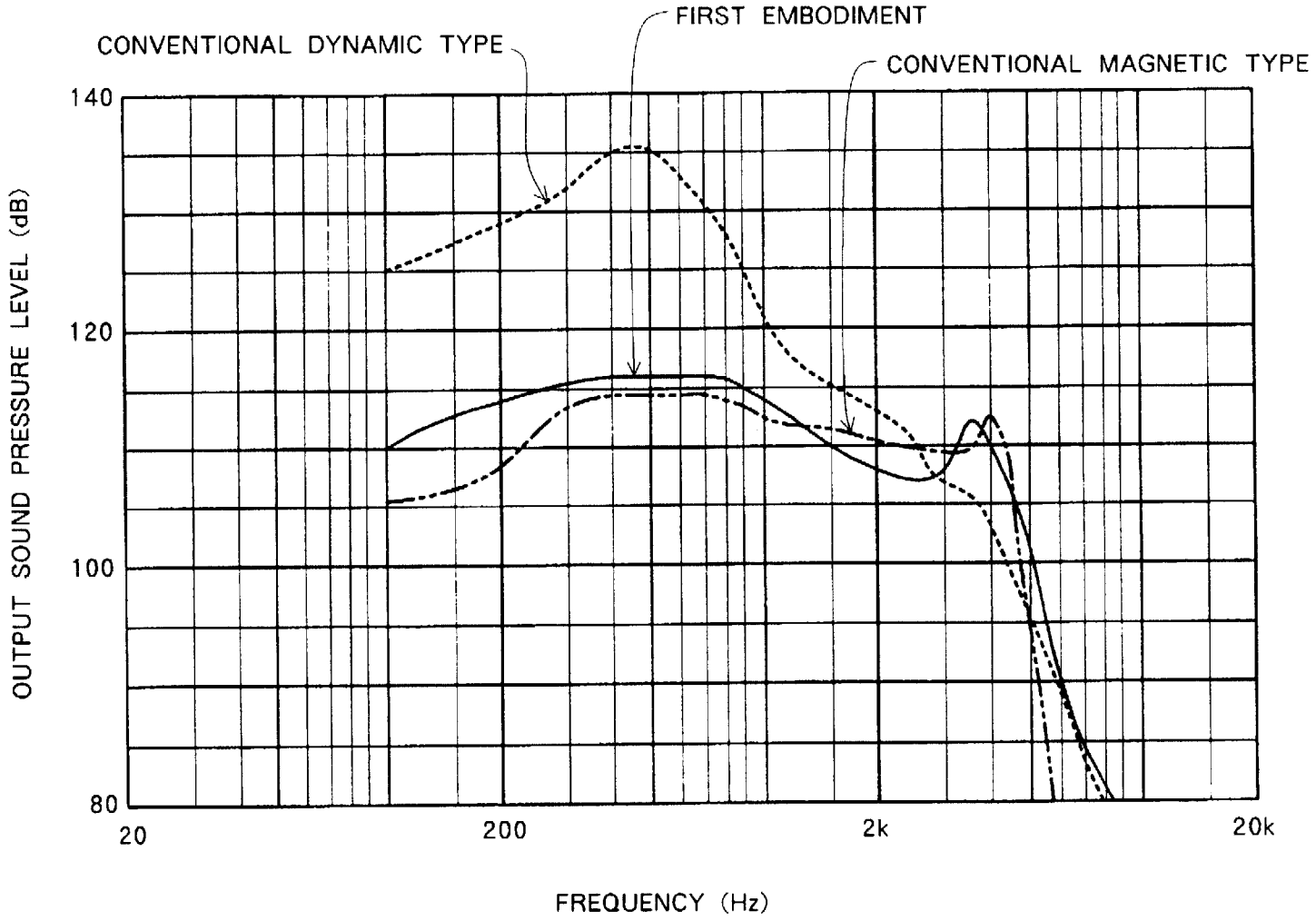
FIG. 5 is a graph showing the sound pressure level-frequency characteristics of the embodiment and conventional speakers.

FIG. 5 shows the sound pressure level-frequency characteristics of the speaker of the first embodiment in a solid line, and those of conventional dynamic speaker and magnetic speaker in a dotted line and a two-dot-and-dash line, respectively. It is generally required that speakers have a high and flat sound pressure level over a low to high frequency range as their characteristics, and the sound pressure level is interpreted as indicating the efficiency.

The drawing reveals that the speaker of the first embodiment has a higher sound pressure level than the conventional magnetic speaker over a wide frequency range and exhibits flat frequency characteristics unlike the conventional dynamic speaker.

Second Embodiment

Figure 6:
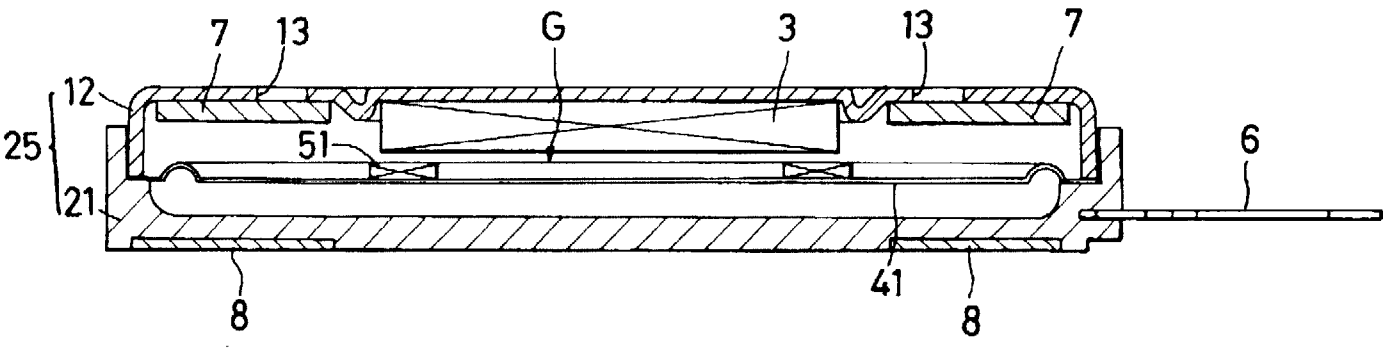
FIG. 6 is a sectional view showing the construction of a speaker as a second embodiment.
Figure 7:
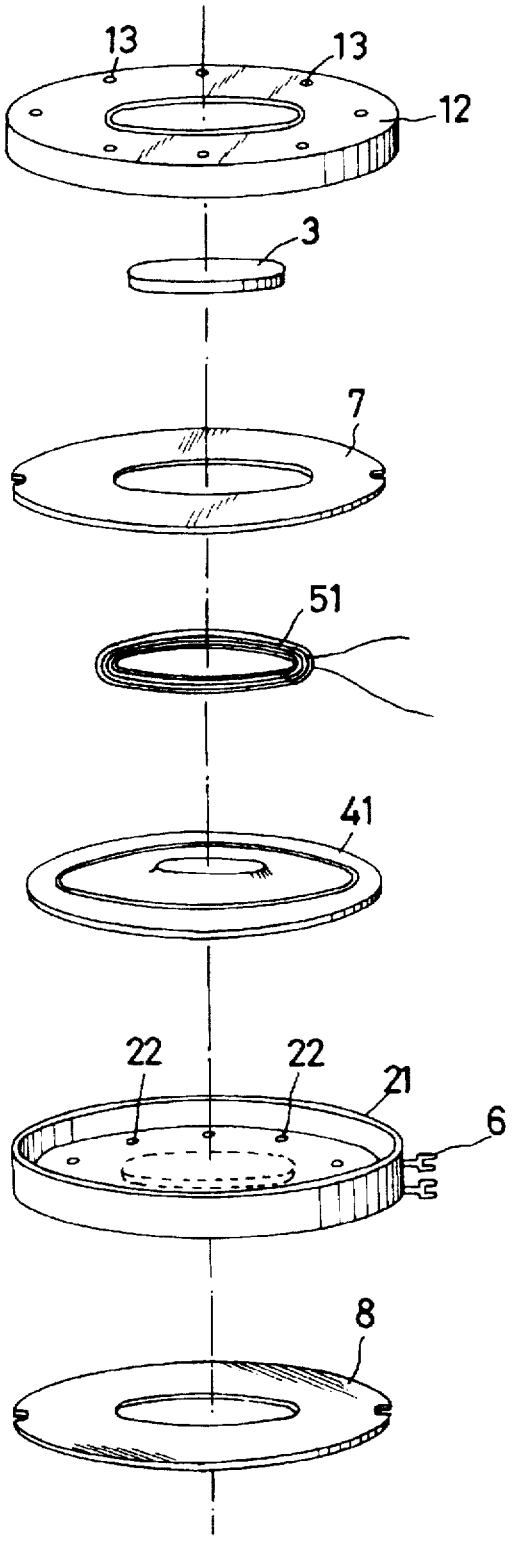
FIG. 7 is an exploded perspective view of the same embodiment.

FIG. 6 is a sectional view showing the construction of another speaker as a second embodiment, and FIG. 7 is an exploded perspective view of the speaker.

A hollow cylindrical cover 12 having an open end is fitted to a hollow cylindrical frame 21 having an open end to form a flat casing 25. The cover 12 is made of a metal such as stainless stell SUS304, and the frame 21 a resin such as liquid crystal polymer.

For the release of sound, the cover 12 is formed with eight holes 13 having a diameter of 1.0 mm and arranged at a spacing of 45 degrees about the center of the cover. The frame 21 also has eight holes 22 having a diameter of 0.4 mm and arranged at a spacing of 45 degrees. A d.c. magnetic field generating magnet 3 consisting primarily of neodymium and in the form of a disk, 9.0 mm in outside diameter and 1.0 mm in thickness, is fixed to the inner surface of the cover 12 concentrically therewith with an acrylic thermosetting adhesive.

Disposed inside the casing 25 is a disklike diaphragm 41 made of polyethylene terephthalate PET and having a thickness of 75 micrometers. The diaphragm 41 has an outer peripheral portion held between the cover 12 and the frame 21 and fixed thereto with an adhesive. A drive coil 51 coaxial with the magnet 3 is mounted on the upper surface of the diaphragm 41 and spaced apart from the magnet 3 by a gap G of 0.6 mm. The coil is fixed to the diaphragm with a rubber adhesive. The drive coil 51 is 7.0 mm in inside diameter, 9.5 mm in outside diameter and 0.25 mm in thickness, and is formed by winding a polyurethane copper wire having a diameter of 0.03 mm.

Accordingly, the drive coil 51, although having the same outside diameter and thickness as the drive coil 5 of the first embodiment, is increased in inside diameter and therefore reduced in weight.

Electrodes 6 prepared by plating brass with solder are attached to the bottom of the frame 21. Lead wires (not shown) extending from the drive coil 51 are engaged with the inner ends of the respective electrodes 6 and connected thereto by soldering.

An annular thin sound absorbing material 7 prepared from polyurethane and nylon is fixedly adhered to the inner surface of the cover 12 and positioned to cover the holes 13. Further a similar sound absorbing material 8 is fixedly adhered also to the bottom of the frame 12 in a position to cover the holes 22.

With the speaker of the second embodiment, the drive coil 51 has a larger inside diameter than the drive coil 5 of the first embodiment and is therefore almost free of the drive force due to the flux penetrating through the drive coil approximately perpendicular thereto and shown in FIGS. 3 (*a*) and 4 (*a*). The diaphragm 41 is driven mainly by drive forces due to the flux obliquely penetrating the drive coil 51 as shown in FIGS. 3 (*b*) and 4 (*b*).

Figure 8:
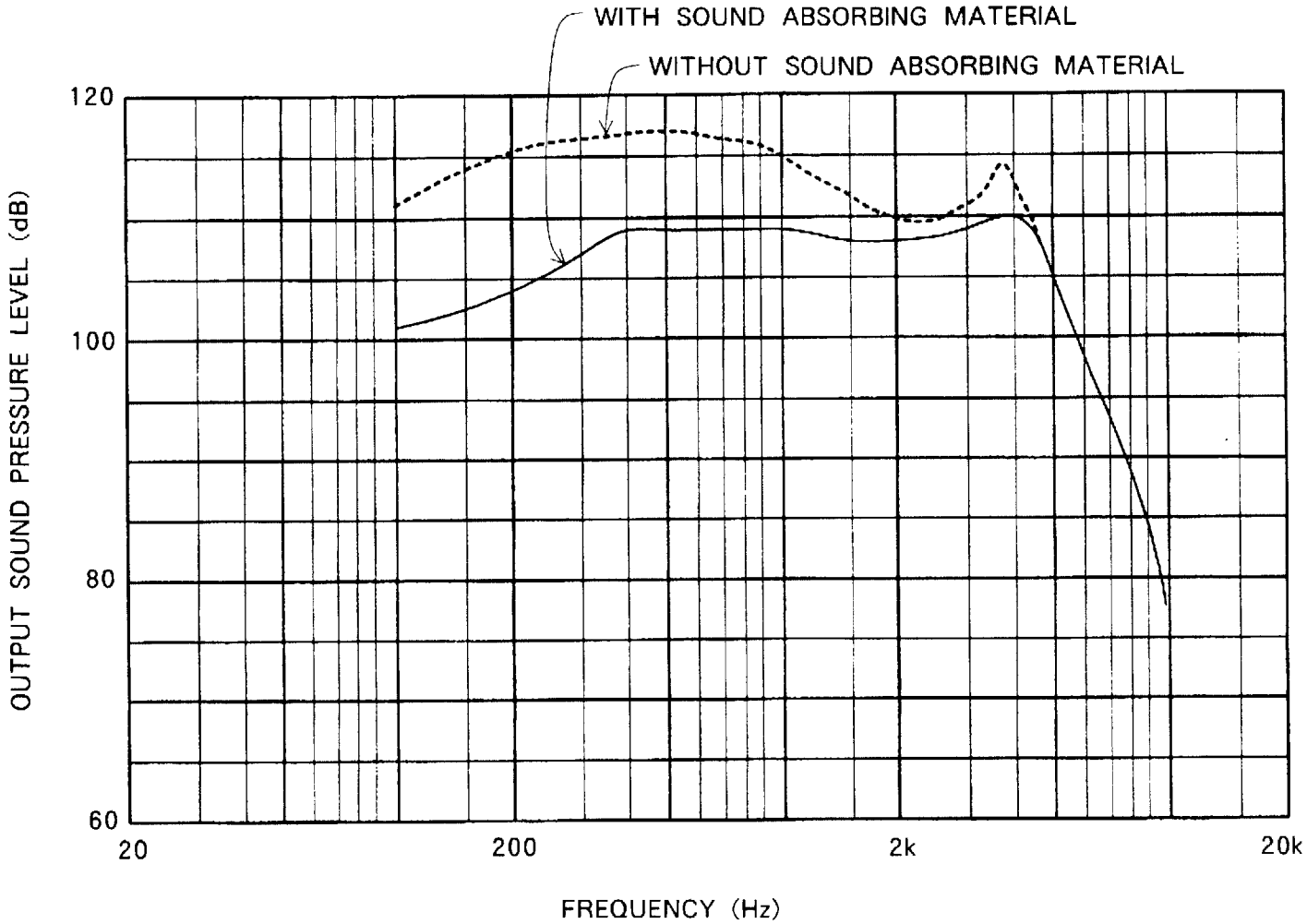
FIG. 8 is a graph showing the sound pressure level-frequency characteristics of the embodiment as determined with a sound absorbing material installed therein and in the absence of the material.

FIG. 8 shows the sound pressure level-frequency characteristics of the speaker of the second embodiment incorporating the sound absorbing material (solid line), and those of the speaker without the material (broken line).

In the absence of the sound absorbing material, the speaker of the second embodiment exhibits a higher sound pressure level than the conventional magnetic speaker shown in FIG. 5 and has flat characteristics unlike the conventional dynamic speaker. By virtue of the sound absorbing effect of the material, the speaker of the invention is lower in sound pressure level when incorporating the material than when not provided with the material, but is yet satisfactory in the sound pressure level for use as a small-sized speaker, further exhibiting flatter characteristics over a low to high frequency range.

FIG. 9 is a table showing various characteristics of the speakers of the invention described, and the conventional dynamic speaker and magnetic speaker.

Although the speakers have substantially the same diameter, the first and second embodiments are smaller than the conventional speakers in overall height because the yoke and pole pieces are omitted in the case of the invention.

In impedance, the first and second embodiments are higher than the dynamic type because the absence of the yoke and pole piece according to the invention ensures freedom of design, permitting an increase in the number of turns of the drive coil.

The drive coil of the second embodiment is the same as the coil of the first embodiment in outside diameter and height and is larger than the latter in inside diameter, but is nevertheless equivalent thereto in impedance because the second embodiment is smaller than the first in the diameter of copper wire of the drive coil.

The first embodiment and the second embodiment not incorporating the sound absorbing material are higher than the magnetic type in sound pressure level because the magnetic flux emanating from the magnet is effectively utilized in the present invention.

The effective use of the magnetic flux according to the invention will be discussed with reference to FIGS. 10 and 11.

Figure 10:
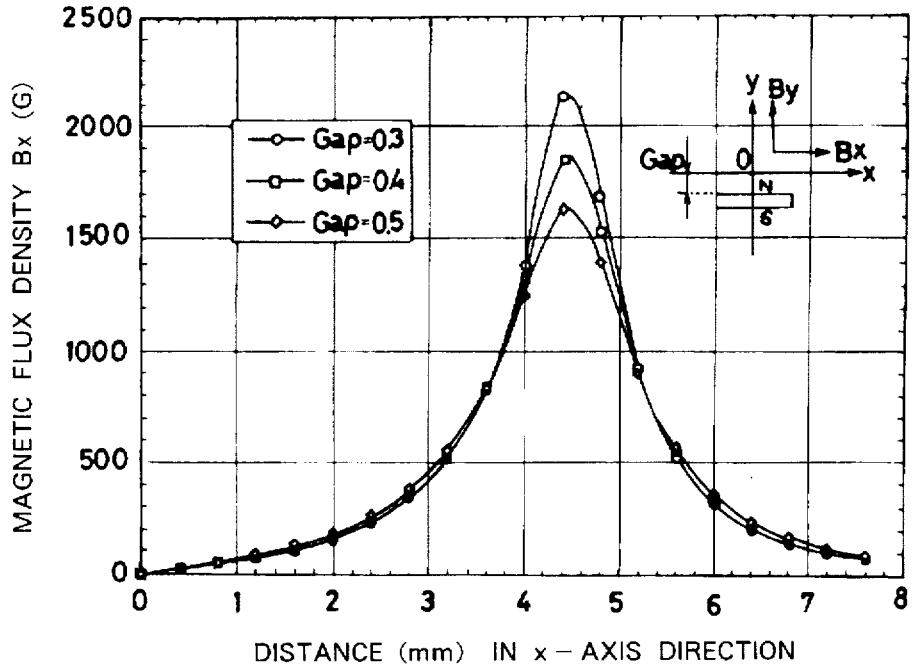
FIG. 10 is a graph showing distributions of magnetic flux density values parallel to a d.c. magnetic field generating magnet.

FIG. 10 is a graph wherein plotted as abscissa is the distance from an origin O, located on the center axis of the d.c. magnetic field generating magnet, in the direction of x-axis, and as ordinate the magnetic flux density component Bx parallel to the magnet to show magnetic density distributions in the case where the gap is 0.3, 0.4 and 0.5 mm.

As illustrated, high flux density values Bx exceeding 800 G are obtained when the distance along x-axis is in the range of 3.6 to 5.2 nm regardless of the value of the gap. Still higher flux density values are available when the distance is in the range of 4.0 to 4.8 mm, and a peak appears around 4.4 mm. An increase in the flux density component Bx in the direction of x-axis causes the drive coil to produce a greater electromagnetic force according to Fleming's left-hand rule. Accordingly, when the drive coil has an outside diameter of 7.2 to 10.4 mm, preferably 8.0 to 9.6 mm, the electromagnetic force according to Fleming's left-hand rule efficiently drives the coil. In the case of the first and second embodiments, the outside diameter of the drive coil is 9.5 mm which is nearly optimum. Consequently, the first and second embodiments are higher than the magnetic type in sound pressure level as previously stated.

Further as shown in FIG. 9, the second embodiment, when not incorporating the sound absorbing material, is higher than the first embodiment in sound pressure level for the reason to be described below.

Figure 11:
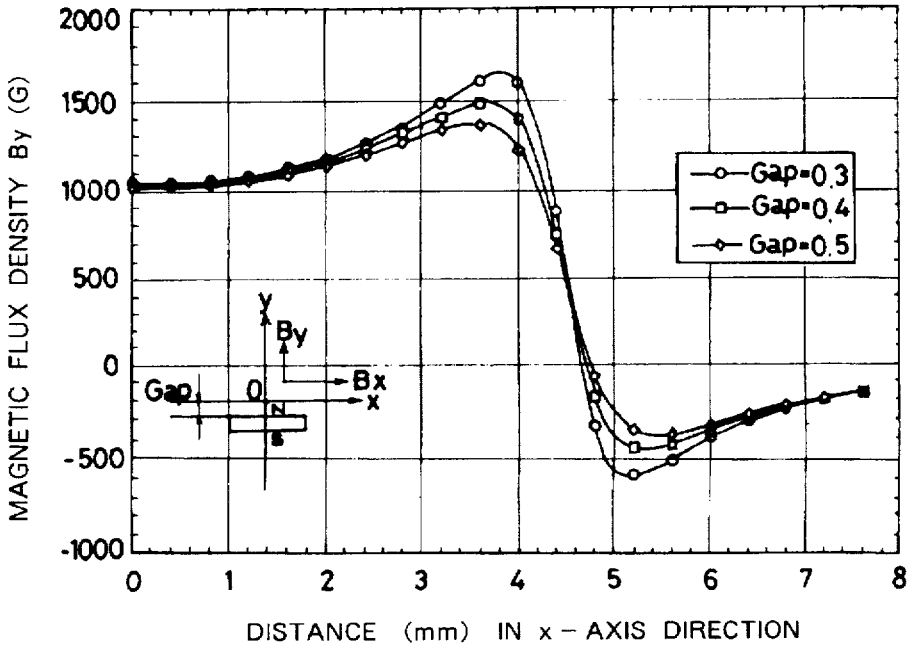
FIG. 11 is a graph showing distributions of magnetic flux density values perpendicular to the d.c. magnetic field generating magnet.
Figure 12:
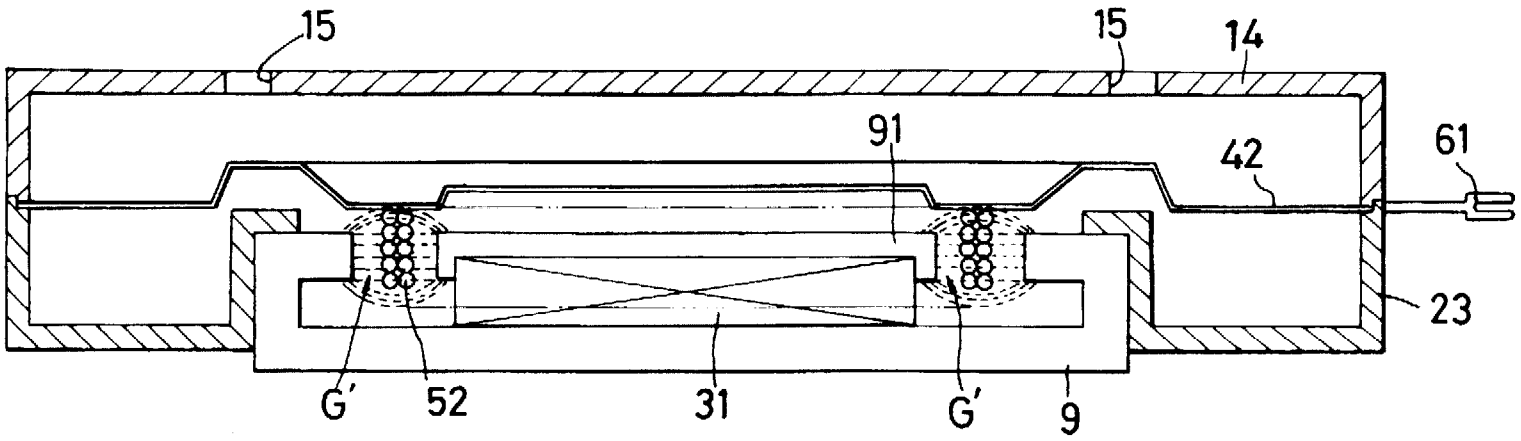
FIG. 12 PRIOR ART
FIG. 12 is a sectional view showing the construction of a conventional dynamic speaker.
Figure 13:
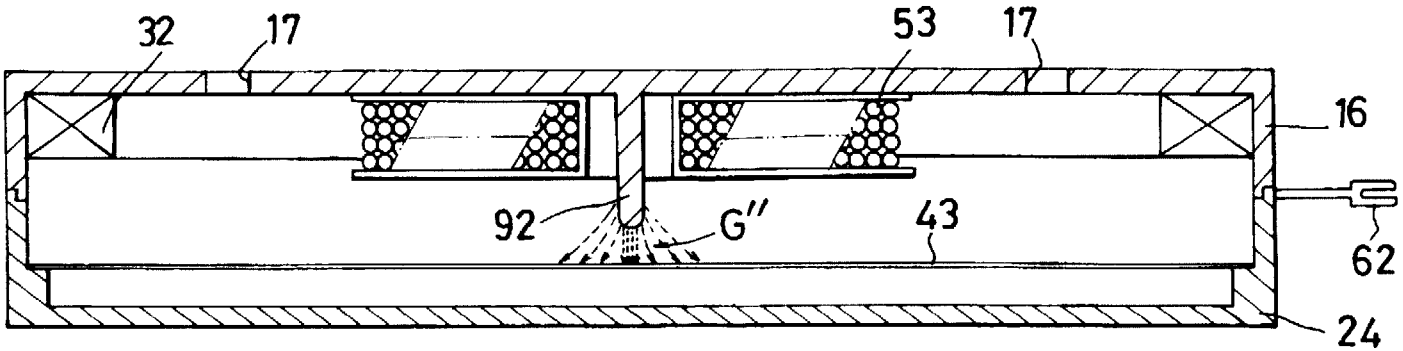
FIG. 13 PRIOR ART
FIG. 13 is a sectional view showing the construction of a conventional magnetic speaker.

FIG. 11 is a graph wherein plotted as abscissa is the distance from an origin O, located on the center axis of the d.c. magnetic field generating magnet, in the direction of x-axis, and as ordinate the magnetic flux density component By perpendicular to the magnet to show magnetic density distributions in the case where the gap is 0.3, 0.4 and 0.5 mm.

As illustrated, high flux density values By in excess of 1000 G are obtained when the distance along x-axis is in the range of 0 to 4.2 mm regardless of the value of the gap. Still higher flux density values are available when the distance is in the range of 3.3 to 4.0 mm, and a peak appears around 3.8 mm. An increase in the flux density component By in the direction of x-axis increases the force of attraction and repulsive force of the magnet acting on the drive coil. However, when the distance along x-axis exceeds 4.7 mm, the flux density component By becomes a negative value.

With FIG. 10 taken into consideration, FIG. 11 reveals the following. When the distance along x-axis is less than 3.0 mm, the electromagnetic force according to Fleming's left-hand rule and shown in FIG. 10 is small. Therefore, if the inside diameter of the drive coil is at least 6.0 mm and in the range of up to 8.4 mm which gives a relatively high value of flux density component By, more preferably, if the inside diameter is 7.0 to 8.0 mm, the drive coil can be driven efficiently by the electromagnetic force according to Fleming's left-hand rule and additionally by the force of attraction and repulsive force of the magnet serving as auxiliary forces. With the second embodiment, accordingly, the inside diameter of the drive coil is set at 7.0 mm in contrast to 1.0 mm for the first embodiment to thereby assure the drive coil of an efficient operation and reduce the weight of the coil. The reduction in the weight of the coil diminishes the mass of the vibration system including the diaphragm, giving improved responsiveness to the system. As a result, the second embodiment is higher than the first in sound pressure level.

The sound absorbing material installed in the second embodiment achieves an improvement to give flatter sound pressure level-frequency characteristics as shown in FIG. 8.

Further as shown in FIG. 9, the first and second embodiments are made smaller than the conventional speakers in the number of parts because the yoke and pole piece are omitted from these embodiments. However, the second embodiment includes the sound absorbing material and is therefore greater than the first in the number of components.

According to the present invention, the magnetic flux emanating from the d.c. magnetic field generating magnet is allowed to extend through a gap without being concentrated as described previously. This eliminates the need for the yoke or pole piece, thereby decreases the number of components and makes the device thinner. The device is free of the limitations to be imposed by the yoke or pole piece in design and can therefore be designed as desired to reduce the thickness, realize a higher impedance by increasing the number of turns of the drive coil and diminish the power consumption.

Furthermore, the drive coil is given an outside diameter which assures effective use of the electromagnetic force according to Fleming's left-hand rule, whereby the coil is made operable efficiently to achieve an improved efficiency.

According to the second embodiment, the inside diameter of the drive coil is set at a value which permits effective utilization of the magnetic flux emanating from the magnet and which further reduces the weight of the coil. This enables the coil to operate more efficiently to achieve a further improved efficiency.

The foregoing description of the embodiments is intended to illustrate the invention and should not be construed as limiting the invention set forth in the appended claims or reducing the scope thereof. The construction of the present device is not limited to those of the embodiments but can of course be modified variously without departing from the spirit of the invention as set forth in the claims.

What is claimed is:

1. An electroacoustic transducer comprising a diaphragm having a peripheral portion as a fixed end, a hollow cylindrical drive coil fixed to one surface of the diaphragm centrally thereof and having an axis perpendicular to the diaphragm, and a d.c. magnetic field generating magnet in the form of a disk and fixed in position as spaced apart from the diaphragm by a predetermined gap, the magnet being coaxial with the drive coil, the gap extending over the entire area of a surface of the magnet and said surface facing the diaphragm, the magnet emanating magnetic flux from the entire area of said surface of the magnet, a major portion of the magnetic flux passing through both the drive coil and the gap in the axial direction of the drive coil.

2. An electroacoustic transducer as defined in claim 1 wherein the outside diameter of the drive coil is at least 80% to not greater than 116% of the diameter of the magnet.

3. An electroacoustic transducer as defined in claim 2 wherein the outside diameter of the drive coil is at least 88% to not greater than 107% of the diameter of the magnet.

4. An electroacoustic transducer as defined in claim 1 wherein the inside diameter of the drive coil is at least 66% to not greater than 94% of the diameter of the magnet.

5. An electroacoustic transducer as defined in claim 4 wherein the inside diameter of the drive coil is at least 77% to not greater than 89% of the diameter of the magnet.

6. An electroacoustic transducer as defined in claim 1 wherein the drive coil is fixed to the diaphragm on the surface thereof facing the magnet.

7. An electroacoustic transducer as defined in claim 1 wherein the drive coil is fixed to the diaphragm on the surface thereof opposite the magnet.

* * * * *